US006696508B2

(12) United States Patent
Willmer et al.

(10) Patent No.: US 6,696,508 B2
(45) Date of Patent: Feb. 24, 2004

(54) THICKENER FOR TEXTILE PRINTING WHICH IS A POLYMER DISPERSION AND HAS IMPROVED BIODEGRADABILITY

(75) Inventors: Kurt Willmer, Reutlingen (DE); Thomas Fischer, Beuren (DE)

(73) Assignee: CHT R Beitlich GmbH, Tubingen (DE)

( * ) Notice: Subject to any disclaimer, the term of this patent is extended or adjusted under 35 U.S.C. 154(b) by 0 days.

(21) Appl. No.: 09/863,390

(22) Filed: May 24, 2001

(65) Prior Publication Data

US 2002/0035181 A1 Mar. 21, 2002

(30) Foreign Application Priority Data

May 31, 2000 (DE) ..... 100 27 016

(51) Int. Cl.[7] ..... C08K 5/15; C08K 5/01; C08K 5/10

(52) U.S. Cl. ..... 523/124; 523/160; 524/57; 524/62; 524/160; 524/306; 524/310; 524/312; 524/315; 524/317; 524/320; 524/321

(58) Field of Search ..... 523/124, 160; 524/306, 310, 312, 315, 317, 320, 321, 57, 62

(56) References Cited

U.S. PATENT DOCUMENTS 5,532,300 A 7/1996 Koubek et al. ..... 524/47

FOREIGN PATENT DOCUMENTS

| | | | |
|---|---|---|---|
| DE | 33 02 069 A1 | 8/1983 | ..... C08J/3/02 |
| DE | 19617716 A1 | 11/1997 | ..... C08J/3/03 |
| EP | 0 045 720 | 2/1982 | ..... C08F/220/60 |
| EP | 0 080 976 | 6/1983 | ..... A61K/7/06 |
| EP | 0 208 217 A1 | 1/1987 | ..... C08F/2/32 |
| EP | 1065226 A1 | 1/2001 | ..... C08F/212/04 |

*Primary Examiner*—Kriellion A. Sanders
(74) *Attorney, Agent, or Firm*—Venable, LLP

(57) ABSTRACT

A thickener for textile printing which is a polymer dispersion and includes at least one polymer selected from the group consisting of (A) at least one polymer derived from monomers having an ethylenically unsaturated double bond, (B) at least one ethylenically unsaturated carboxylic acid ester, (C) at least one ethylenically unsaturated carboxylic acid anhydride, and (D) at least one ethylenically unsaturated carboxylic acid amide; and a synthetic carrier medium comprised of at least one biodegradable component which may have varying respective biodegradabilities and which is selected from the group consisting of at least one ester which is at least one of an ester of synthetic origin and an ester of natural origin and which is liquid at room temperature and below.

45 Claims, No Drawings

THICKENER FOR TEXTILE PRINTING WHICH IS A POLYMER DISPERSION AND HAS IMPROVED BIODEGRADABILITY

BACKGROUND OF THE INVENTION

1. Field of Invention

The present invention relates to a polymer dispersion with improved biodegradability.

2. Description of the Related Art

In printing shops, automatic ink stations which can prepare printing pastes in a fully automatic process are increasingly employed. The presence of liquid metering components, such as liquid dye and thickener formulations, is advantageous for automatic dosage. A printing paste essentially consists of water, a thickener and a dye, as well as other auxiliary agents in accordance with the printing method employed.

Textile printing methods can be divided into pigment printing, dye printing, carpet printing, carpet spray printing and others. The classes of dyes employed include, for example, pigments, reactive dyes, disperse dyes, acid dyes, basic dyes, metal complex dyes and/or vat dyes. The printing plants employed include, for example, rotary machine printing, flat printing, roller printing, spray printing, ink jet printing, space printing, Vigoureux (melange) printing and others.

In addition to woven and knitted fabrics, worsted yarns, engineering fabrics, fleeces, sheets, papers etc., carpets are also printed. In this case, rotary machine printing and carpet spray printing are mainly employed. In carpet spray printing, two types of plants are prevalent which use different methods of working and are designated by the two suppliers as Chromojet® (Zimmer) and Millitron® (Milliken). Today, the Chromojet® plant is predominantly operated with synthetic printing thickeners. The principle is that a printing paste is supplied under pressure to a magnetically controlled nozzle whose timing is controlled by a computer in accordance with the pattern to be printed. In the Millitron® plant, a permanent jet of printing paste is deflected onto the substrate or back into the storage vessel in accordance with the printing image. Both Chromojet® and Millitron® are equipped with a large number of nozzles.

All printing methods require a particular viscosity and rheology in order to obtain a printing performance which is the best in each case. Thus, the thickeners (printing gums) are of central importance in every printing paste formulation.

In principle, for the mentioned printing methods, dyes and substrates, native or synthetic thickeners can be used.

Known synthetic printing thickeners mostly comprise polyacrylates or copolymers of acrylic acid with other ethylenically unsaturated compounds which may additionally be cross-linked. The pure polyacrylic acid derivatives are in the form of powders and thus only conditionally suitable for automatic metering devices. Further, for polyacrylic acid in the form of powder, a maximum allowable concentration was established in the newly introduced category 4 (non-genotoxic carcinogens which allow for threshold values to be established). Thus, in the future, restrictions to the handling of polyacrylic acid in the form of powder are possible.

Today, in addition to the use of powdery thickeners for manual dosage, the state of the art is to use paste-like synthetic thickeners which may be obtained either by emulsion polymerization of acrylic acid or its derivatives or by dispersing the powdery polyacrylic acid or its derivatives in a suitable dispersant. Paste-like thickeners which are currently on the market are predominantly based on mineral oils as water-in-oil emulsions with a high solids content, and their use results in the pollution of waste water with poorly biodegradable or non-biodegradable hydrocarbons. The mineral oils are deposited in the sewage sludge of water treatment plants and degraded by microorganisms only in very low amounts.

A precondition for the use of paste-like formulations of powdery polyacrylic acid derivatives is the preparation of a stable dispersion. A number of factors are responsible for the stability of such dispersions, for example, viscosity, rheology, density of the carrier medium, pH value, filler content, use of dispersing aids and the like. As to viscosity, carrier media having too low a viscosity are less suitable because stable dispersions can hardly be obtained therewith. But too high a viscosity is also disadvantageous because in this case, the paste-like polyacrylic acid derivatives can no longer be processed in automated ink formulation plants.

To obtain polyacrylates having a good thickening effect, the polyacrylic acid must be neutralized. The prior art especially comprises ammonium, sodium, potassium salts and quaternary amines.

The water-in-oil emulsions currently on the market must be inverted when incorporated in water; only then, the polymer can swell and become active in its function as a printing thickener. With self-swelling paste-like thickener systems, this reversal of the emulsion can proceed by itself upon incorporation into water, but with non-self-swelling systems, a surface-active compound must be added, or high shear forces must be applied.

In EP 0 208 217 A, environment-friendly flocculant organosols based on dicarboxylic acid esters are described. In industrial-scale syntheses, they are prepared with economic efficiency and constant quality. Consequently, the biological degradation proceeds from the oxygen-containing sites of the molecule, perhaps after a preliminary hydrolytic cleavage of the ester group, for example, catalyzed by enzymes, and both the carbon chains of the dicarboxylic acid and those of the alcohol are microbially degraded by β-oxidation to the highest possible extent.

DE 33 02 069 A describes preparations in which the oil phase may consist of a mixture of aliphatic or aromatic hydrocarbons with natural vegetable or animal triglycerides, and of fatty acid monoesters, preferably $C\text{-}_{1\text{-}4}$ alkyl esters of $C_{12\text{-}24}$ fatty acids.

EP 0 045 720 A and EP 0 080 976 A describe water-in-oil emulsion polymerizates for use in cosmetic agents which require hydrophobic organic liquids, such as aliphatic or aromatic hydrocarbons, oils of animal or vegetable origin, and the corresponding denaturing oils as the oil phase for the polymerization.

The present invention is concerned with the problem of the pollution of waste water with hydrocarbons by the paste-like formulation of printing thickeners. At the same time, easier-to-handle paste-like formulations of polymers were to be developed.

SUMMARY OF THE INVENTION

In a first embodiment, the invention relates to a polymer dispersion containing one or more polymers in a synthetic carrier medium which is completely or partially biodegradable. For a constant product quality, it is advantageous to use biodegradable synthetic carrier media.

In particular, the invention relates to a polymer dispersion containing one or more polymers and a synthetic carrier medium based on a biodegradable component, or a mixture of biodegradable components, or a mixture of one or more biodegradable components with one or more less readily biodegradable components.

The term "polymer dispersion" within the meaning of the present invention also comprises emulsions of polymers.

Natural vegetable oils or their derivatives often consist of a mixture of different fatty acids. They contain residues of different chain lengths and different degrees of saturation, depending on the respective vegetable base. In some cases, a smaller amount of polymer can be incorporated in a vegetable oil than can be incorporated in formulations based on mineral oil or synthetic carrier media. Therefore, according to the present invention, these are less suitable as a carrier medium for the polymer dispersion.

As compared to vegetable oils, synthetic carrier media have the advantage that they can be produced in a constant quality. As a rule, they contain one or more defined compounds or, for multiple esters, they contain the acid in different stages of esterification. Further, it was found that a higher active content of polymer dispersions is achieved in many cases in synthetic carrier media. This means that a higher amount of powdery polyacrylic acid can be dispersed in a synthetic carrier medium before its viscosity becomes too high or the resulting paste-like formulation has an insufficient storage stability. Another advantage of certain synthetic organic carrier media is their improved storage stability as compared to a carrier medium based on mineral oil. With paste-like formulations of polymers in mineral oils, problems with storage stability may arise in such terms that the emulsion/dispersion becomes unstable and, on the one hand, a part of the polymer deposits on the bottom of the vessel and is in part sedimented to such a high extent that the paste-like formulation can no longer be converted to its original state and thus often becomes useless. On the other hand, with systems containing mineral oils, oil is found to be segregating on the surface. Both phenomena cause a concentration gradient inside the storage vessel, which may result in application errors when not taken into account.

Another advantage of synthetic organic carrier media is an ageing stability which is improved as compared to biological oils and, associated therewith, a smell and consistency which do not change. In contrast, biological oils can take an offensive smell after some time from ageing, and the consistency of the system may also change (skinning, change in viscosity).

Another positive property is the partially improved dispersibility of the polymer in synthetic organic media as compared to mineral oils, which results in a facilitated and accelerated production of the paste-like formulation, also with a broadened range of pH values.

As synthetic carrier media, monoesters which are liquid at room temperature and also at lower temperatures may be preferably employed. There may be mentioned, in particular, esters of linear $C_1$ to $C_{30}$ carboxylic acids of the "fatty" acid residue, which may also be branched or mono- or polyunsaturated and substituted with ether or hydroxy groups. The linear or branched saturated or mono- or polyunsaturated alcohol component which is optionally substituted with ether or hydroxy groups can be formed from $C_1$ to $C_{30}$ alcohols having one or more hydroxy groups, as is the case with the trihydroxy compound glycerol in vegetable oils. In combination with long-chained hydroxy compounds, short-chained organic acids, such as acetic acid, propionic acid and the like, may also be employed for esterification. On the other hand, short-chained alcohols, such as methanol, ethanol and the like, can also be employed together with long-chained acids or polyacids.

The ester group may also be present several times in the esters of dicarboxylic acids or compounds with 3 and more carboxy groups, such as in derivatives of citric acid. It is not necessary that all carboxy groups are esterified.

As acid components, in addition to the preferred saturated ones, those having unsaturated C—C bonds are also useful, for example, oleic acid. This primarily applies to transesterified esters of natural origin and also to mixtures of saturated and unsaturated fatty acids.

Thus, the present invention also encompasses the use of transesterified products of natural or synthetic origin.

Explicitly, there may also be used esters prepared from glycerol, diglycerol, triglycerol or tetraglycerol including per se known polyglycerols as the alcoholic base. Both mixed esters and esters of a single acid can be prepared. Glycerol may be wholly or partially esterified. In addition to glycerol, other polyhydric alcohols may also be used as the alcohol component, for example, the saccharides in their open-chained reduced form, such as mannitol or sorbitol. The polyols may be subject to a single esterification, as in the case of sorbitan monofatty acid esters, or to multiple esterification. Also, esters of saccharides and oligosaccharides may be employed.

Of course, mixtures of the mentioned esters may also be employed.

The present invention also relates to mixtures of biodegradable synthetic carrier media with inert hydrophobic liquids which are less readily biodegradable, for example, kerosines, naphthas, isoparaffins, mineral oil or mixtures of biodegradable synthetic carrier media with naturally occurring oils.

Useful polymers include, in particular, the polymerizates of monomers having an ethylenically unsaturated double bond, for example, unsaturated carboxylic acids, such as acrylic acid, methacrylic acid, maleic acid, itaconic acid, ethylenically unsaturated carboxylic acid esters, such as methyl acrylate, acrylonitriles, ethylenically unsaturated carboxylic acid anhydrides, such as maleic anhydride, ethylenically unsaturated carboxylic acid amides, such as acrylamide, methacrylamide. The polymers may be employed as homo- or copolymers. Copolymers may also include other ethylenically unsaturated monomers, such as 2-acrylamido-2-methylpropanesulfonic acid (AMPS), vinylsulfones, vinylpyrrolidone and/or vinyl acetate and the like.

Of course, according to the invention, any other polymers having a thickening effect may also be employed.

To improve their properties in terms of application technology, the polymers may also be cross-linked in accordance with the prior art.

One advantage of the carrier media employed according to the invention, especially esters, is their stability with the neutralized, partially neutralized or non-neutralized form of polyacrylic acid. In the case of the neutralized or partially neutralized form, the sodium, potassium and ammonium acrylates and the quaternary amines are preferably employed. The polymers incorporated into the dispersion in a non-neutralized form can be neutralized when dispersed. This may be done by introducing gaseous, solid or liquid bases, such as ammonia, sodium carbonate or amines. In addition, the polymers may also be neutralized or partially neutralized with other suitable compounds.

Another advantage of the polymer dispersion according to the invention is the fact that the pH value can be freely adjusted over a broad range. With formulations comprising carrier oils based on mineral oils, this causes problems and may result in a limited storage stability of the formulation, because the stability of the emulsion is dependent on the pH value.

To the polymer dispersion according to the invention, there may also be added surface-active substances which emulsify the carrier medium during the preparation of the printing pastes, mostly by introducing the invention into water.

Further, for the preparation of a paste-like thickener formulation, dispersing aids and wetting agents may also be employed which can stabilize the dispersion and control the swelling process when incorporated into water. Known emulsifiers include, for example, sorbitan monostearate and sorbitan monooleate. The emulsifiers may preferably be employed in amounts of from 0.1 to 30%, preferably from 1 to 15%, based on the total amount.

Water may also be added to the formulation if this is found advantageous for the preparation or stability of the paste-like formulation.

In addition to dispersing aids, wetting agents or stabilizers, auxiliary agents known per se in the prior art selected from the group consisting of defoamers, acidifiers, printing oils, fixation accelerators, coacervation agents and other auxiliary agents common in printing processes can be admixed with the paste-like thickener formulation. Mixtures of these auxiliary agents may also be employed. Thus, auxiliary agents within the meaning of the present invention include usual additives known in the textile field.

The main application field of the polymer dispersion according to the invention is dye printing, especially printing with disperse, reactive, acid and metal complex dyes onto the substrates polyester, polyamide, wool, cellulosic fibers and, in particular, carpets.

More preferably, the polymer dispersions according to the invention may be employed for carpet spray printing.

DETAILED DESCRIPTION OF INVENTION

EXAMPLES

Example 1

In a dispersing apparatus, 20 kg of triisodecyl citrate was charged, and 9 kg of polyacrylic acid (Gelacril® 703) was dispersed therein with cooling. After transfer to a gas-tight reactor equipped with an anchor agitator, about 1 kg of ammonia was added, and the pH value was occasionally checked. With the aid of the added quantity of ammonia, the pH value was adjusted to 6.2.

A white to light beige viscous paste having a viscosity of 6000 mPa·s (Brookfield RVT, 20 rpm) and pH 6.2 was obtained. In water, using a dispersing apparatus, the paste was self-inverting and yielded a viscosity of 13,600 mPa·s (Brookfield RVT, 20 rpm) at 1.4% in water.

The paste-like formulation proved to be absolutely stable to storage over a period of several months both at room temperature and at elevated temperature. No sedimentation of the polymer and no separation of the carrier medium from the paste could be observed.

Application Example

The above paste-like formulation was used for the preparation of a spray printing paste for use on a Chromojet® laboratory printing plant CHR LS to print a carpet according to the spray printing method.

The paste-like thickener formulation from Example 1 was caused to swell with deionized water in an dispersing apparatus and mixed with the remaining components.

The spray printing paste was prepared from deionized water, the paste-like formulation, citric acid for controlling the pH value, Rapidoprint GT 6 (defoamer) and a dye.

| Component | Quantity employed |
|---|---|
| Deionized water | 969.72 g |
| Paste-like formulation from Example 1 | 7.53 g |
| Rapidoprint GT 6 | 1 g |
| Citric acid | 1.05 g |
| Tectilon ® Yellow 3R 200% | 0.2 g |
| Tectilon ® Red 2B 200% | 0.2 g |
| Tectilon ® Blue 4R01 200% | 0.4 g |

The resulting spray printing paste had a viscosity of 1700 mPa·s (Brookfield RVT, 20 rpm) and a pH value of 5.8.

Using a laboratory spray printing plant manufactured by the Zimmer company, a spray print was prepared on a carpet specimen. The printing conditions were 65% slide speed and a working pressure of 2 bar. A polyamide carpet was employed as the substrate. After printing, the carpet, while still wet, was steamed with saturated steam at 102° C. for 8 min and finally washed with water.

The pattern produced by spray printing had a good contour acuity, a good penetration into the fibers of the carpet specimen, and did not show any color deviations.

Examples 2 to 12

In a dispersing apparatus, 20 kg of triisodecyl citrate was charged, and 9 kg of polyacrylic acid (Carbopol® 846) was dispersed therein with cooling. The performing and stability were analogous to those in Example 1.

A white to light beige viscous paste having a viscosity of 11,700 mPa·s (Brookfield RVT, 20 rpm) and pH 6.2 was obtained. In water, using a dispersing apparatus, the paste was self-inverting and yielded a viscosity of 20,000 mPa·s (Brookfield RVT, 20 rpm) at 1.4% in water.

In the following Examples, the esters were charged in an amount of 200 g each, and the polyacrylic acid was dispersed therein at a speed of 3000 rpm with cooling in a double-walled stainless steel vessel using a toothed disk, and was not neutralized. Stable dispersions were produced which are characterized by the time to disperse the polymer therein and their viscosity.

| Ex. | Carrier medium | Polymer | Dispersing time [min] | Viscosity, initial [mPa · s] | Viscosity after 1 week [mPa · s] |
|---|---|---|---|---|---|
| 2 | mixtures of dibutyl esters of malonic, succinic, glutaric and adipic acids | 703* | 2 | 9,300 | 8,900 |
| 3 | mixtures of dibutyl esters of malonic, succinic, glutaric and adipic acids | 846** | 5 | 17,500 | 19,000 |
| 4 | ethylhexyl ethylhexanoate | 703* | 2 | 2,500 | 2,400 |
| 5 | isobutyl tallow fatty acid ester | 703* | 2 | 2,550 | 2,750 |
| 6 | butylglycol acetate | 703* | 2 | 14,600 | 17,500 |
| 7 | butyl acetate | 703* | 2 | 3,250 | 4,100 |
| 8 | sorbitan monooleate | 703* | 3 | 13,000 | 11,200 |
| 9 | tridecyl citrate/mineral oil of bp. >235° C. | 703* | 2 | 360 | 500 |
| 10 | tridecyl citrate, dicarboxylic acid butyl ester, isobutyl tallow fatty acid ester | 703* | 2 | 9,400 | 10,400 |
| 11 | tridecyl citrate | 702* | 2 | 6,600 | 5,500 |
| 12 | tridecyl citrate | 1030** $NH_3$ neutr. | 3 | 7,200 | 6,000 |

*Gelacril ®
** Carbopol ®

What is claimed is:

1. A thickener for textile printing which is a polymer dispersion, comprising:

at least one polymer selected from the group consisting of (A) at least one polymer derived from monomers having an ethylenically unsaturated double bond, (B) at least one ethylenically unsaturated carboxylic acid ester, (C) at least one ethylenically unsaturated carboxylic acid anhydride, and (D) at least one ethylenically unsaturated carboxylic acid amide; and a synthetic carrier medium comprised of at least one biodegradable component which may have varying respective biodegradabilities and which is selected from the group consisting of at least one ester which is at least one of an ester of synthetic origin and an ester of natural origin and which is liquid at room temperature and below.

2. The thickener according to claim 1, wherein (A) the at least one polymer derived from monomers having an ethylenically unsaturated double bond is at least one unsaturated carboxylic acid; (B) the at least one ethylenically unsaturated carboxylic acid ester is at least one of a methyl acrylate and an acrylonitrile; (C) the at least one ethylenically unsaturated carboxylic acid anhydride is maleic anhydride; and (D) the at least one ethylenically unsaturated carboxylic acid amide is at least one of acrylamide and methacrylamide.

3. The thickener according to claim 2, wherein the at least one unsaturated carboxylic acid is selected from the group consisting of acrylic acid, methacrylic acid, maleic acid and itaconic acid.

4. The thickener according to claim 1, wherein the synthetic carrier medium is selected from the group consisting of monoesters of synthetic origin of:

linear or branched, saturated or mono- or polyunsaturated $C_1$ to $C_{30}$ carboxylic acids which may be optionally substituted with one of ether or hydroxy groups, and linear or branched, saturated or mono- or polyunsaturated $C_1$ to $C_{30}$ alcohols which may be optionally substituted with at least one of ether and hydroxy groups.

5. The thickener according to claim 1, wherein the synthetic carrier medium is selected from the group consisting of esters of:

dicarboxylic acids with linear or branched, saturated or mono- or polyunsaturated $C_2$ to $C_{30}$ acid components which may be optionally substituted with at least one of ether and hydroxy groups, and linear or branched, saturated or mono- or polyunsaturated $C_1$ to $C_{30}$ alcohols which may be optionally substituted with at least one of ether and hydroxy groups.

6. The thickener according to claim 5, wherein the esters may be esters produced by one of single or double esterification of the dicarboxylic acids and may be mixed esters.

7. The thickener according to claim 1, wherein the synthetic carrier medium is selected from the group consisting of esters of:

poylvalent carboxylic acids with linear or branched, saturated or mono- or polyunsaturated $C_3$ to $C_{20}$ acid components having more than two carboxy groups which may be optionally substituted with at least one of ether and hydroxy groups, and linear or branched, saturated or mono- or polyunsaturated $C_1$ to $C_{30}$ alcohols which may be optionally substituted with at least one of ether and hydroxy groups.

8. The thickener according to claim 7, wherein the esters may be esters produced by one of single or double esterification of the polyvalent carboxylic acids.

9. The thickener according to claim 7, wherein the polyvalent carboxylic acids are derived from citric acid.

10. The thickener according to claim 9, wherein the citric acid has hydroxy groups which are esterified by reaction with acetic anhydride.

11. The thickener according to claim 7, wherein the linear or branched, saturated or mono- or polyunsaturated $C_1$ to $C_{30}$ alcohol are derived from at least one of glycerol, diglycerol, triglycerol, tetraglycerol, and polyglycerol, and the esters are one of mixed esters or esters of a single acid.

12. The thickener according to claim 11, wherein the linear or branched, saturated or mono- or polyunsaturated $C_1$ to $C_{30}$ alcohol comprises divalent alcohols which are at least one of (a) wholly esterified or partially esterified and (b) esterified to form one of pure esters or mixed esters.

13. The thickener according to claim 1, wherein the synthetic carrier medium is selected from the group consisting of esters of a polyhydric alcohol having at least three hydroxy groups which are one of wholly or partially esterfield.

14. The thickener according to claim 13, wherein the polyhydric alcohol is at least one saccharide having an open-chained, reduced form.

15. The thickener according to claim 13, wherein the polyhydric alcohol is at least one sugar alcohol.

16. The thickener according to claim 15, wherein the at least one sugar alcohol is selected from the group consisting of mannitol and sorbitol.

17. The thickener according to claim 1, wherein the synthetic carrier medium is selected from the group consisting of esters which comprise transesterified esters of one of vegetable or animal origin.

18. The thickener according to claim 1, further comprising mixtures of natural fats and oils with synthetic esters which are liquid.

19. The thickener according to claim 1, further comprising mixtures of synthetic esters with at least one of mineral oil, hydrocarbons and paraffins.

20. The thickener according to claim 1, wherein the at least one polymer comprises one of homo- or copolymers.

21. The thickener according to claim 20, wherein the at least one polymer comprises one of homo- or copolymers with ethylenically unsaturated monomers.

22. The thickener according to claim 21, wherein the ethylenically unsaturated monomers are selected from the group consisting of 2-acrylamido-2-methylpropanesulfonic acid (AMPS), vinylsulfone, vinylpyrrolidone and vinyl acetate.

23. The thickener according to claim 1, wherein the at least one polymer is cross-linked.

24. The thickener according to claim 23, wherein the at least one polymer further comprises ethylenically polyunsaturated comonomers and is cross-linked due to the ethylenically polyunsaturated comonomers.

25. The thickener according to claim 1, wherein the at least one polymer comprises one of polyacrylates or copolymers in one of (a) a neutralized form, (b) partially neutralized form, or (c) as a non-neutralized acid.

26. The thickener according to claim 25, wherein the neutralized form and the partially neutralized form of the at least polymer comprise at least one of sodium acrylates, potassium acrylates, ammonium acrylates, and the quaternary amines.

27. The thickener according to claim 1, wherein the at least one polymer having a non-neutralized form is neutralized when dispersed or emulsified.

28. The thickener according to claim 27, wherein the at least one polymer having a non-neutralized form is neutralized when dispersed or emulsified by introducing at least one base in a form which is at least one of a gas, a liquid and a solid.

29. The thickener according to claim 28, wherein the at least one base is selected from the group consisting of ammonia, one of carbonates or hydrogencarbonates, and amines.

30. The thickener according to claim 1, wherein the at least one polymer is introduced into the synthetic carrier medium in an at least partially neutralized form.

31. The thickener according to claim 1, wherein the thickener is a dispersion and wherein the dispersion has a pH value ranging from 0 to 14.

32. The thickener according to claim 31, wherein the pH value ranges from 1 to 9.

33. The thickener according to claim 1, further comprising at least one of dispersing aids, stabilizers, surface-active substances, and auxiliary agents.

34. The thickener according to claim 33, wherein the surface-active substances are emulsifiers.

35. The thickener according to claim 33, wherein the auxiliary agents are selected from the group consisting of defoamers, acidifiers, printing oils, fixation accelerators and coacervation agents.

36. The thickener according to claim 1, further comprising water.

37. A method of printing a textile substrate, comprising:

providing a thickener which is a polymer dispersion according to claim 36; and applying the thickener onto the textile substrate.

38. The method according to claim 37, further comprising incorporating into the thickener at least one substance which is (a) at least one dye which at least one of an acid dye and a metal complex dye and (b) at least one pigment which is at least one of an acid pigment and a metal complex pigment, and which is disperse and reactive.

39. The method according to claim 37, wherein the textile substrate is comprised of a fiber material selected from the group consisting of polyester, polyamide, wool, and cellulosic fiber.

40. The method according to claim 39, wherein the textile substrate is a carpet.

41. A printing paste, comprising:

water;

a thickener which is a polymer dispersion according to claim 1; and at least one dye.

42. A method of printing a textile substrate, comprising:

providing a printing paste according to claim 41; and applying the printing paste onto the textile substrate.

43. The method according to claim 42, further comprising incorporating into the printing paste at least one substance which is (a) at least one dye which at least one of an acid dye and a metal complex dye and (b) at least one pigment which is at least one of an acid pigment and a metal complex pigment, and which is disperse and reactive.

44. The method according to claim 42, wherein the textile substrate is comprised of a fiber material selected from the group consisting of polyester, polyamide, wool, and cellulosic fiber.

45. The method according to claim 43, wherein the textile substrate is a carpet.

* * * * *

UNITED STATES PATENT AND TRADEMARK OFFICE

CERTIFICATE OF CORRECTION

PATENT NO. : 6,696,508 B2
DATED : February 24, 2004
INVENTOR(S) : Kurt Willner et al.

It is certified that error appears in the above-identified patent and that said Letters Patent is hereby corrected as shown below:

Title page,
Item [75], Inventors, delete "Willmer" and insert -- Willner --.

Signed and Sealed this

Twenty-second Day of June, 2004

JON W. DUDAS
*Acting Director of the United States Patent and Trademark Office*